US007958605B2

(12) United States Patent
Greco

(10) Patent No.: US 7,958,605 B2
(45) Date of Patent: Jun. 14, 2011

(54) CAP CLIP

(75) Inventor: Michael A. Greco, Brooklyn, NY (US)

(73) Assignee: Michael A Greco, Brooklyn, NY (US)

( * ) Notice: Subject to any disclaimer, the term of this patent is extended or adjusted under 35 U.S.C. 154(b) by 226 days.

(21) Appl. No.: 12/137,031

(22) Filed: Jun. 11, 2008

(65) Prior Publication Data

US 2009/0307882 A1 Dec. 17, 2009

(51) Int. Cl.
*B65D 71/00* (2006.01)

(52) U.S. Cl. ..... 24/288; 206/159; 294/87.2

(58) Field of Classification Search ..... 24/288; 206/159; 294/87.2
See application file for complete search history.

(56) References Cited

U.S. PATENT DOCUMENTS

| | | | | | |
|---|---|---|---|---|---|
| 2,838,818 | A * | 6/1958 | Brennan | 24/288 |
| 2,898,654 | A * | 8/1959 | Becker | 24/288 |
| 3,038,599 | A * | 6/1962 | Poupitch | 206/159 |
| 3,167,832 | A * | 2/1965 | Holland | 24/288 |
| 3,202,447 | A * | 8/1965 | Whaley et al. | 294/87.2 |
| 3,370,700 | A * | 2/1968 | Shazor, Jr. | 206/159 |
| 4,216,859 | A * | 8/1980 | Bader et al. | 206/159 |
| 2010/0077573 | A1 * | 4/2010 | Greco | 24/457 |

* cited by examiner

*Primary Examiner* — Robert J Sandy
*Assistant Examiner* — Michael Lee

(57) ABSTRACT

A cap clip for fastening caps together is realized employing pressure type pincer snaps, allowing complex geometrical shapes to be formed while reducing the use of fasteners. In one embodiment, the cap clip includes a generally triangular base and three pincer snaps formed integrally with the base along the outer perimeter. Preferably, each pincer snap is comprised of a pair of convex walls and a shared clasping section lying along a radius of curvature path that are co-centric.

5 Claims, 9 Drawing Sheets

CAP CLIP

TECHNICAL FIELD

The present invention generally relates to a cap clip and, more particularly, a cap clip for fastening bottle caps together in different geometrical shapes.

BACKGROUND OF THE INVENTION

Bottle caps are often used to create pop art. For example, decorative art, such as pictures, charms, glitter, or plastic jewels, may be sized to fit inside the bottle cap. Or, the design elements of the caps themselves can be assembled in a mosaic to create pictures through the use of color and texture sequins. Such examples of pop art, however, typically require each bottle cap to be glued or nailed, which is time consuming and somewhat inconvenient. In some cases, this type of fastening also often limits the type of art created.

SUMMARY OF THE INVENTION

The present invention is a cap clip for fastening caps together employing pressure type pincer snaps. Advantageously, caps can be snapped onto either one or more cap clips, allowing complex geometrical shapes to be formed, while reducing the use of fasteners. The design elements of the caps themselves can be assembled in a mosaic to create pictures using color and texture sequins.

In one embodiment, the cap clip includes a generally triangular base and three pincer snaps formed integrally with the base near the outer perimeter and radially positioned 120° apart. Each pincer snap is comprised of a pair of convex plates and a portion of a shared clasping section having a generally triangular shape centrally disposed on the base. The clasping section consists of three outer concave walls extending vertically upward away from the base, and joined laterally to each other along a corresponding edge. Each convex plate extends upward away from the base and lies along a radius of curvature path co-centric with a corresponding concave wall of the clasping section.

In another embodiment, the cap clip has a generally square base with two integral pincer snaps positioned 180° radially apart. Each pincer snap includes a single convex plate and concave walls of a twin clasping section consisting of two triangular sections with a spacing centrally disposed therebetween. Each triangular section has two outer concave walls extending vertically upward away from the base, and joined laterally to each other along a corresponding rounded edge. Each convex plate lies along a radius of curvature path co-centric with corresponding concave walls of the clasping section.

BRIEF DESCRIPTION OF THE DRAWINGS

A more complete understanding of the invention may be obtained by reading the following description in conjunction with the appended drawings in which like elements are labeled similarly, and in which.

DETAILED DESCRIPTION

A cap clip for fastening caps together is realized by employing pressure type pincer snaps near the outer perimeter of the cap clip. Advantageously, caps can be snapped onto either one or more cap clips, allowing complex geometrical shapes to be formed, while reducing the use of fasteners. The design elements of the caps themselves can be assembled in a mosaic to create pictures using color and texture sequins. Although such mosaic patterns and pictures have specific applications in advertising and pop art, its applications are limitless.

Without any loss of generality or applicability for the principles of the invention, the preferred embodiment of the cap clip is described with respect to its application for bottle caps. It should be clearly understood, however, that the present invention is equally applicable to other cap types.

Figure 5:
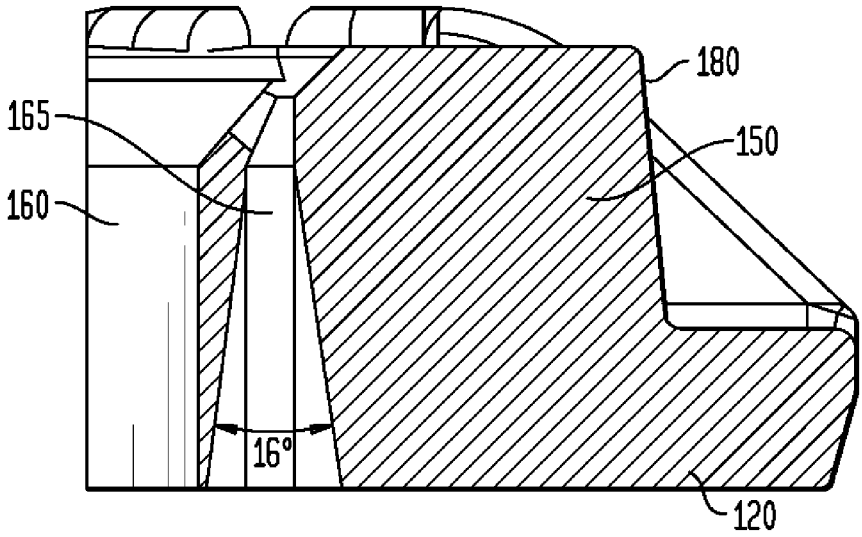
FIG. 5 is a cross section view of the cap clip of FIG. 2 along section B-B.
Figure 6:
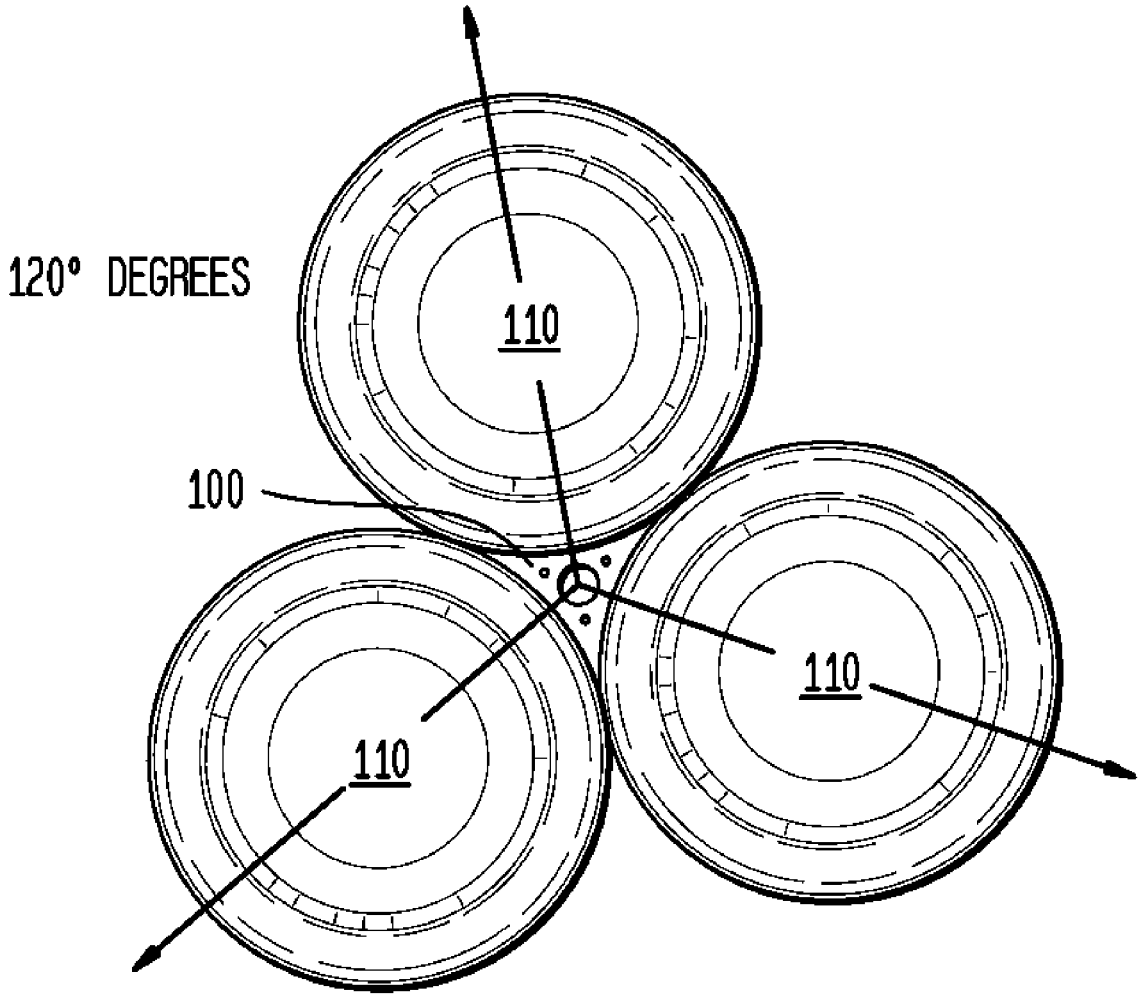
FIG. 6 is a perspective view of the cap clip with bottle caps inserted therein.

Referring to FIGS. 1 through 5, there is shown a cap clip, designated generally by numeral 100, for fastening bottle caps 110 together as shown in FIG. 6. As shown, cap clip 100 has a generally triangular base 120 and three pincer snaps 130 formed integrally with triangular base 120 near the outer perimeter of cap clip 100. Each pincer snap 130 is preferably positioned 120° radially apart for connecting caps 110 likewise 120° apart.

The back side of triangular base 120 is substantially planar with cut-out rectangular openings 135 centrally located below each pincer snap 130. Triangular base 120 has radius corners for readily interconnecting cap clips together, as show in FIG. 6.

Each pincer snap 130 includes twin convex plates 140 and a concave portion of shared clasping section 150 configured to hold a cap of appropriate dimensions. Shared clasping section 150 having a generally triangular shape is centrally disposed on triangular base 120. Fastening devices—not shown—such as screws, nails, tacks, rivets, and the like are inserted into recessed concave opening 160 to attach base 120 to a structure, such as wall, board or other suitable structure. Alternatively, adhesive or adhesive tape may be used on the backside of triangular base 120. Or, the cap clip may be sewed onto a suitable structure using so-called "button" holes 165 located around the perimeter of concave opening 160. As shown, the diameter of the button holes is not uniform, but rather narrows from the base to the top, as shown in FIG. 5.

Figure 1:
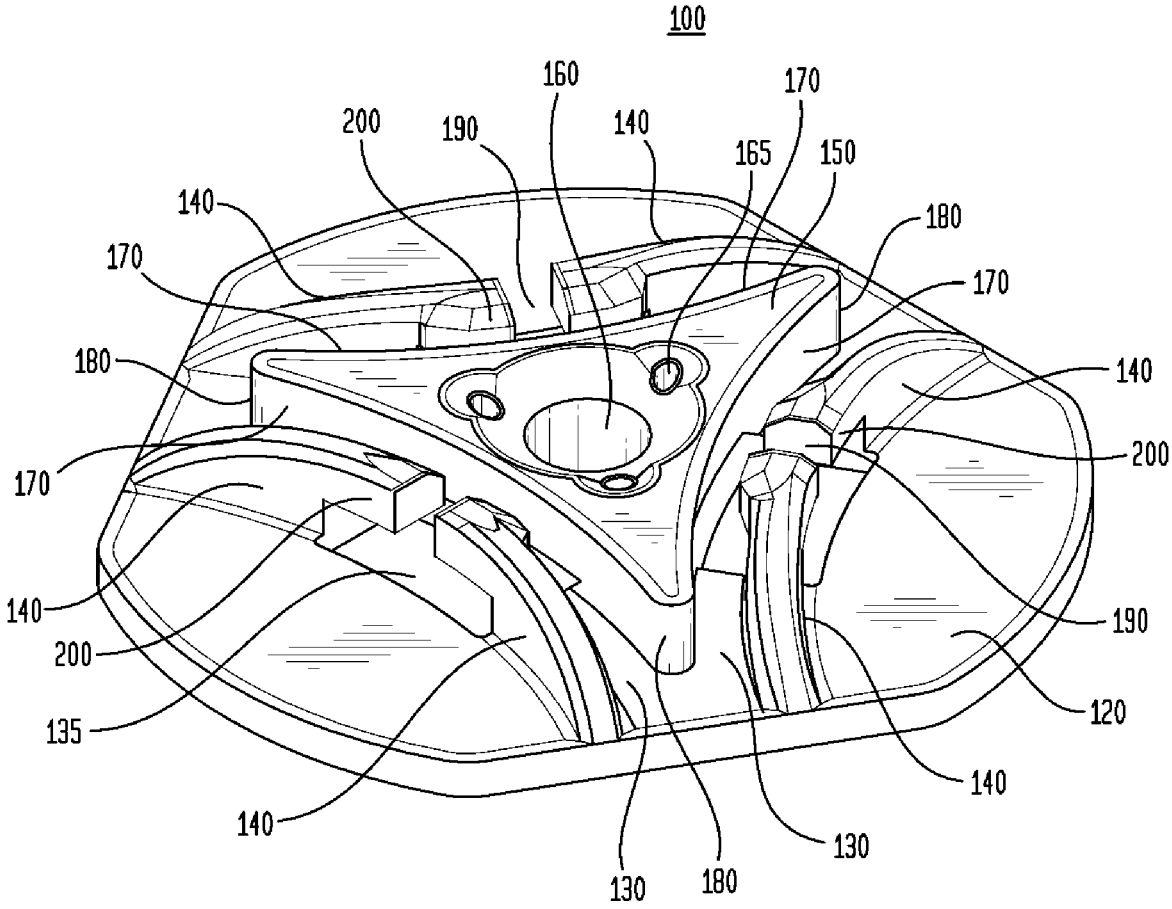
FIG. 1 is a perspective view of a first embodiment of the cap clip constructed in accordance with the principles of the invention.
Figure 2:
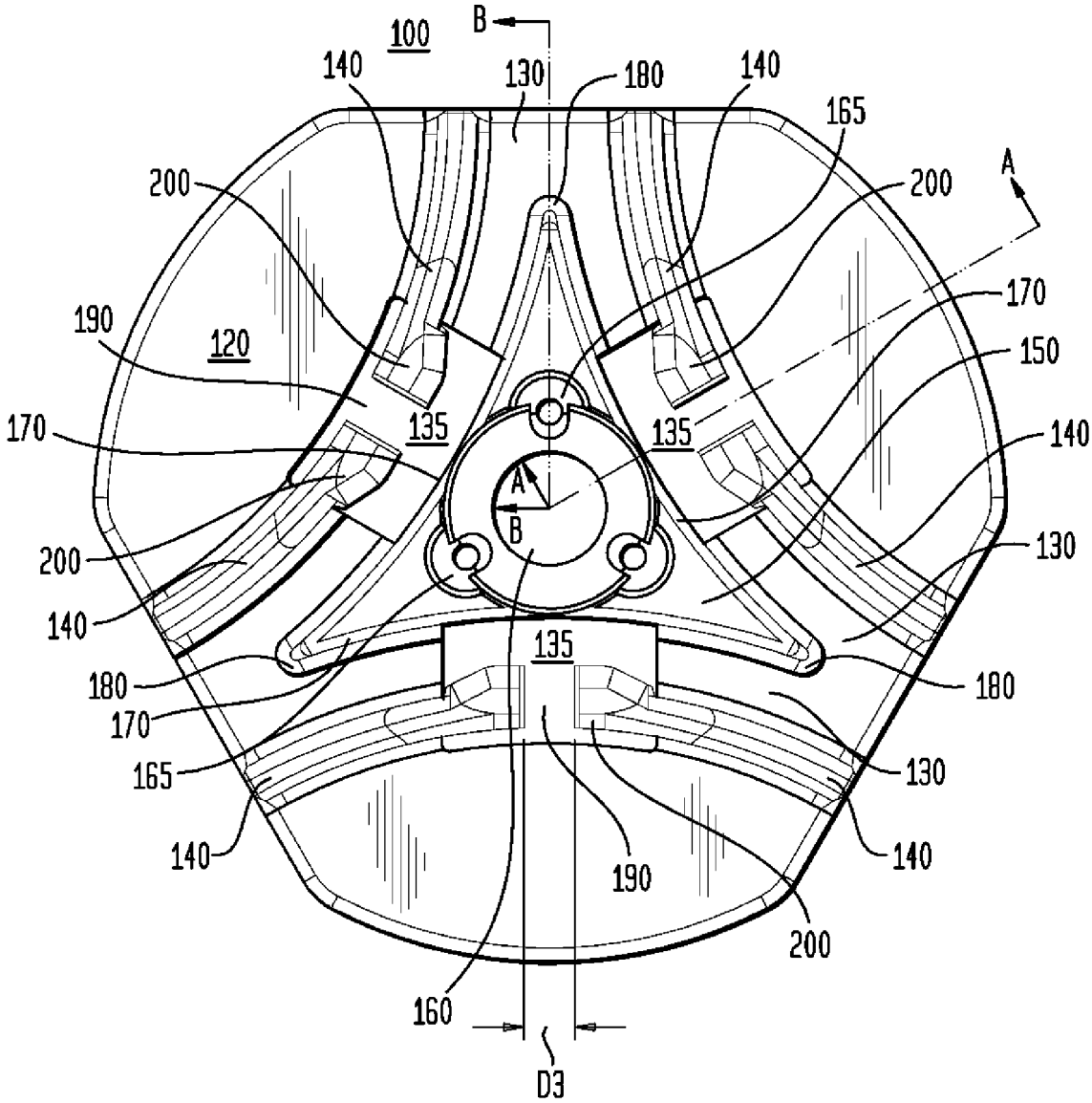
FIG. 2 is a top plan view of the cap clip of FIG. 1.
Figure 3:
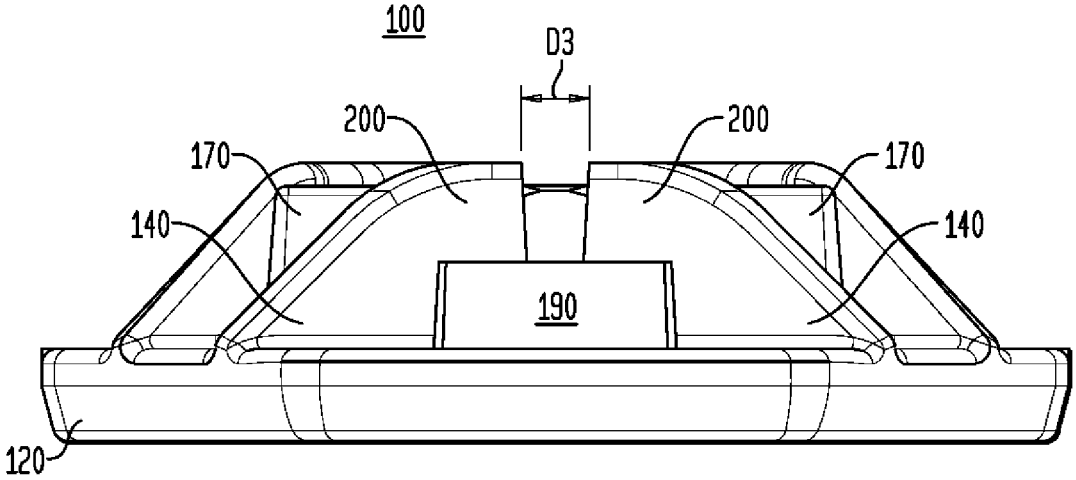
FIG. 3 is side view of the cap clip of FIG. 1.
Figure 4:
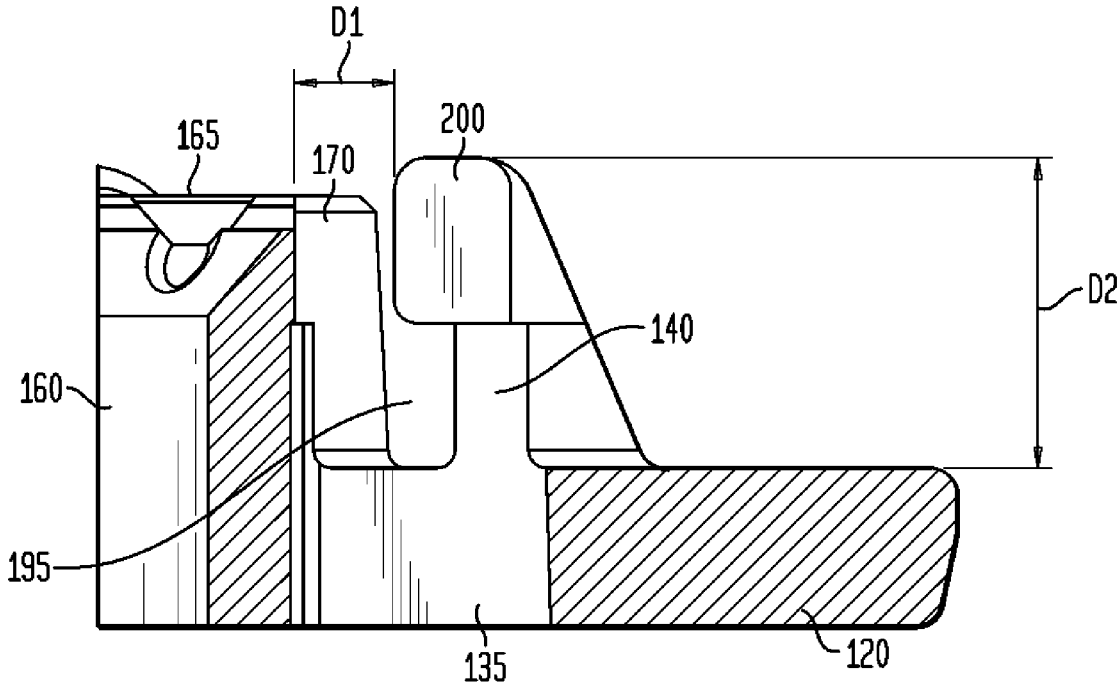
FIG. 4 is a cross section view of the cap clip of FIG. 2 along section A-A.

Shared clasping section 150 consists of three outer concave walls 170 of radius R1 extending vertically upward away from base 120, and joined laterally to each other along a corresponding rounded edge 180 following a curved concave path best shown in FIG. 2. Each pincer snap 130 includes convex plates 140 of radius R2 extending upward away from base 120, with a gap or slot 190 in the form of an inverted T centrally disposed therebetween. Alternatively, the convex plates can be contiguous, as described herein below in another embodiment. Convex plates 140 lie along a radius of curvature path co-centric with the corresponding concave wall 170 of shared clasping section 150, and follow nominally the curvature of the cap. Of course, the radii of curvature R1 and R2 can be chosen to allow cap clip 100 to meet the specifications of most cap types.

Convex plates 140 are spaced radially a distance D1 from the corresponding concave wall 170 of shared clasping section 150 by a recessed channel 195 of depth D2. The distance D1 is judiciously chosen to receive the rim of the bottle cap. Gap or slot 190 facilitates the cap to snap into recessed channel 195 as it pushes convex plates 140 radially outward. At its most distal end, convex plates 140 are spaced apart a distance D3. Since the convex plates are elastic, caps are held tightly by friction within recessed channel 195. That is, each convex plate 140 and the corresponding concave wall 170 clasp the outer rim of the cap. Once the cap is removed, the convex plates return to their original position Convex plates 140 do not extend beyond the external dimensions of triangular base 120. The distal section, however, of the plates preferably have protruding tabs or lips 200 extending generally inward in a radial direction. The tabs are generally perpendicular to the corresponding concave wall 170, and increase the holding friction in the pincer snaps.

Figure 7:
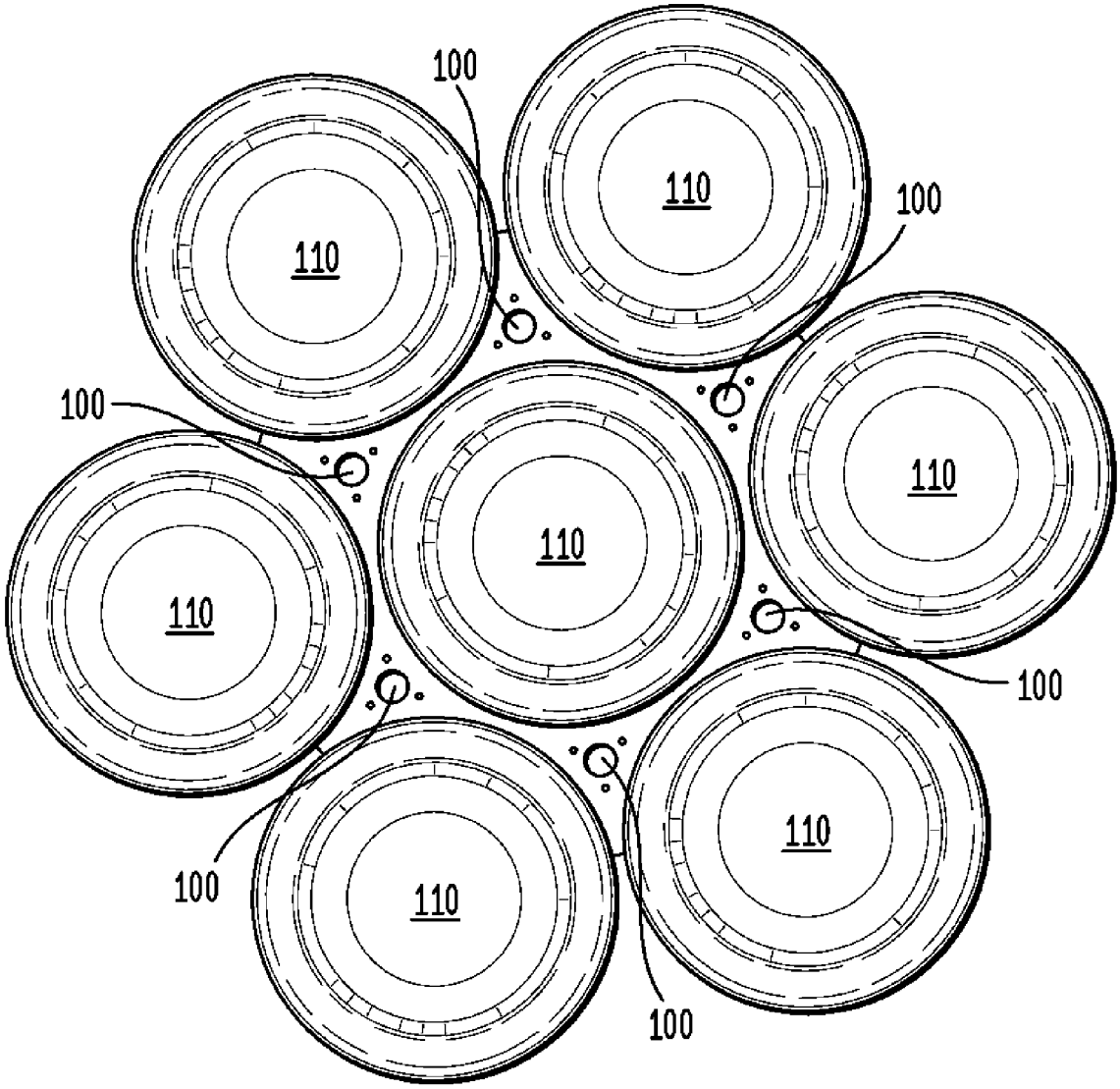
FIG. 7 is perspective view of interconnected cap clips, and bottle caps.
Figure 8:
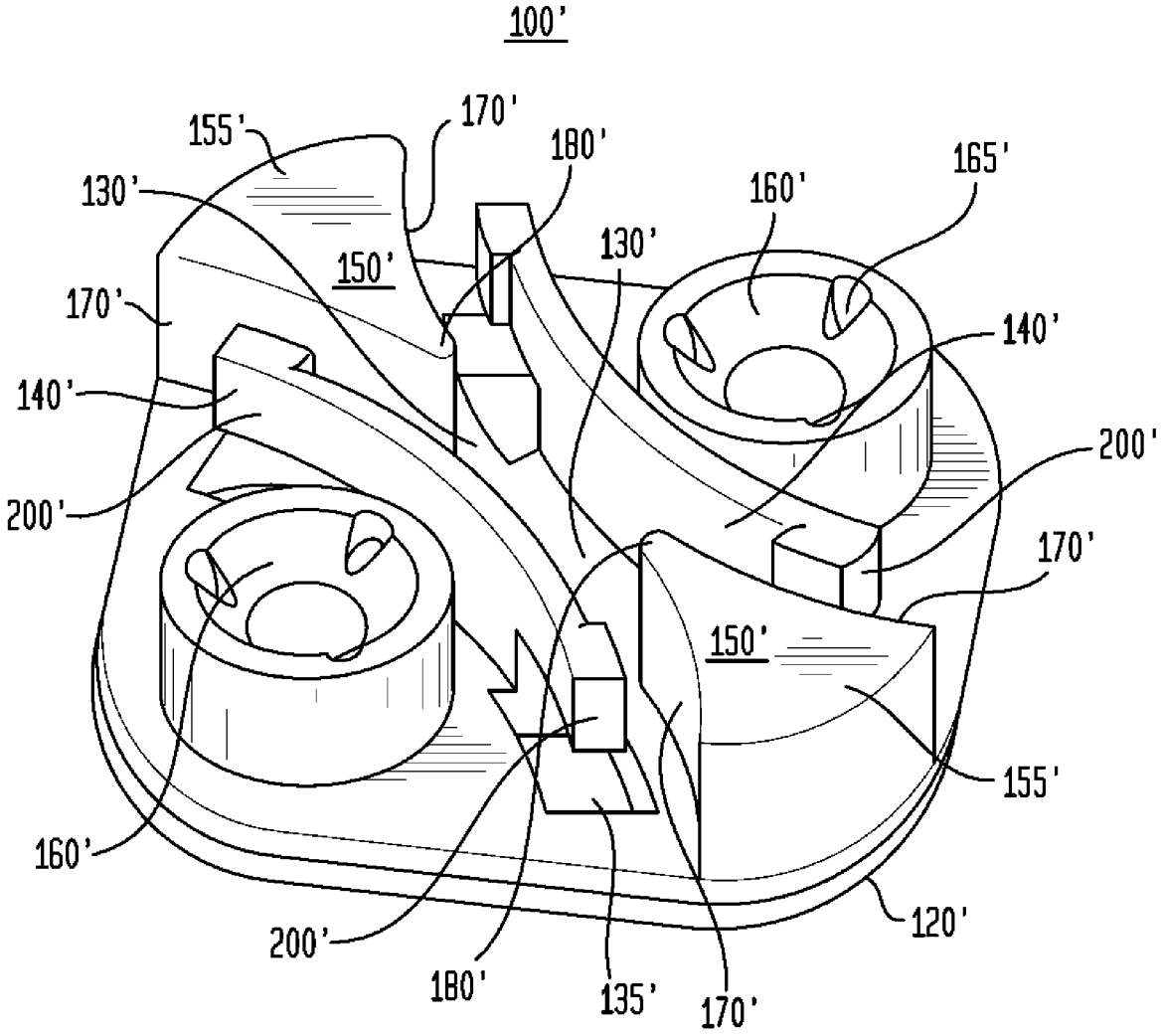
FIG. 8 is a perspective view of a second embodiment of the cap clip constructed in accordance with the principles of the invention.
Figure 9:
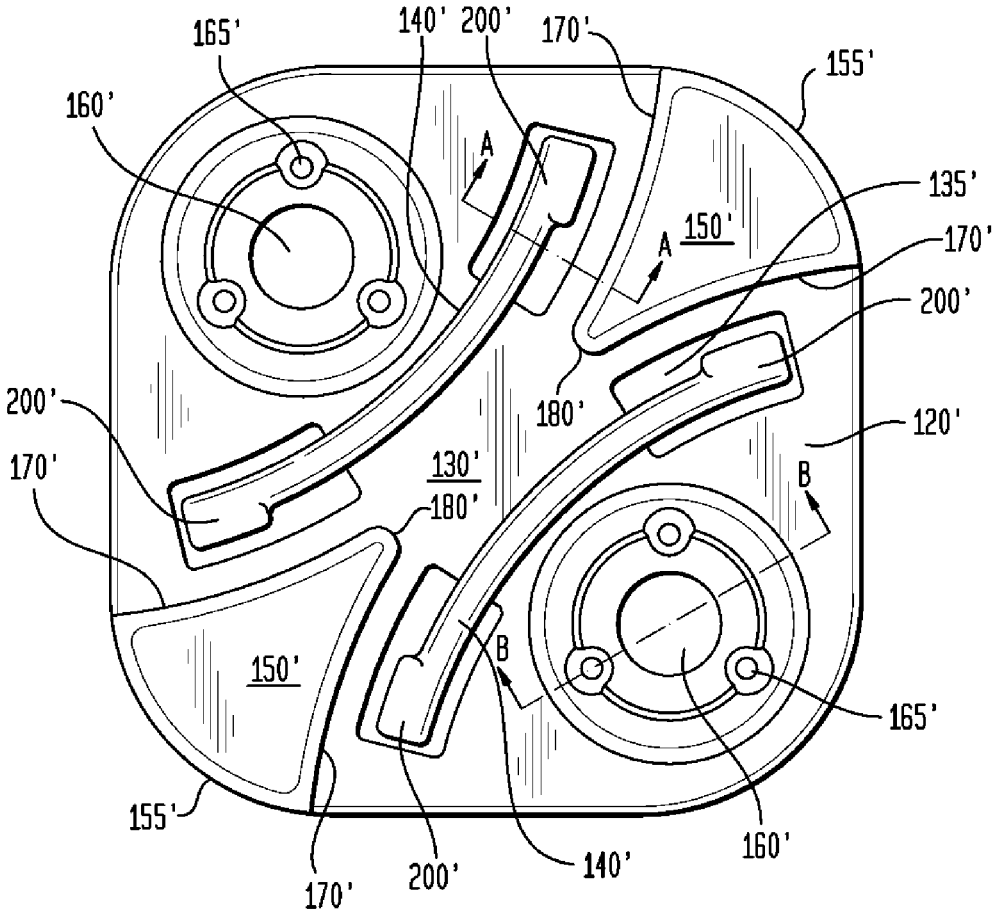
FIG. 9 is a top plan view of the cap clip of FIG. 8.
Figure 10:
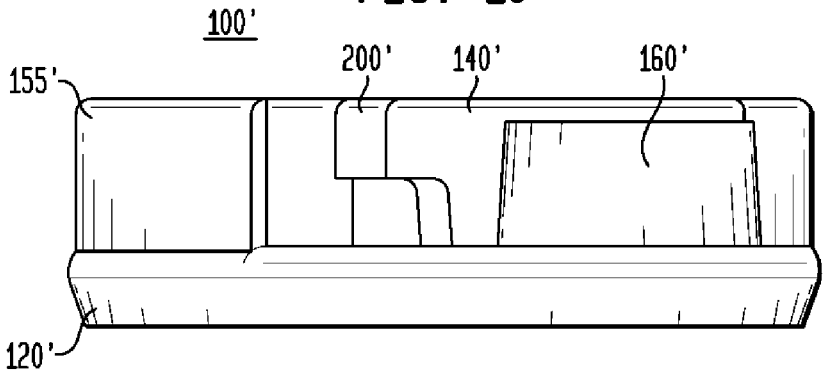
FIG. 10 is side view of the cap clip of FIG. 8.
Figure 11:
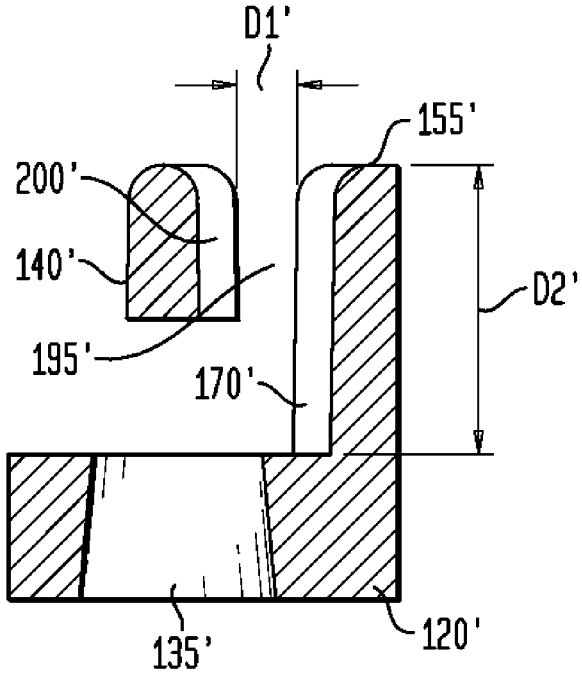
FIG. 11 is a cross section view of the cap clip of FIG. 9 along section A-A.

Referring to FIG. 7, the cap clip of the present invention can be interconnected by allowing the cap to snap onto more than one cap clip. As shown, each cap may be snapped onto up to six cap clips. As such, the present invention allows the caps to be assembled into a mosaic so as to create pictures using color and texture sequins. The cap clips of the present invention can be readily displayed, using nails, screws, rivets or glue, on a variety of different mediums. Advantageously, however, the present invention reduces the number of fasteners required.

In this first embodiment, and for typical bottle caps having about an outer diameter of about 1.264", thickness of about 0.11", and a height of about 0.2618", the nominal diameter of cap clip of the present invention would be about 1.029", with a base height of about 0.125". The total height is 0.3" The radii of the convex plates and concave walls are about 0.747" and 0.836", respectively, The spacing D1, and D3 are about 0.064", and 0.060", respectively. And, the tabs or lips are about 0.105" high, resulting in a recessed channel depth D2 of about 0.20".

Shown in FIGS. 8 through 12 is another embodiment of the inventive cap clip designated generally by numeral 100' with like elements of the first embodiment labeled using prime notation. As shown, cap clip 100' has a generally square base 120' with two integral pincer snaps 130' positioned 180° radially apart. Square base 120' has radius corners for readily interconnecting cap clips together.

Figure 12:
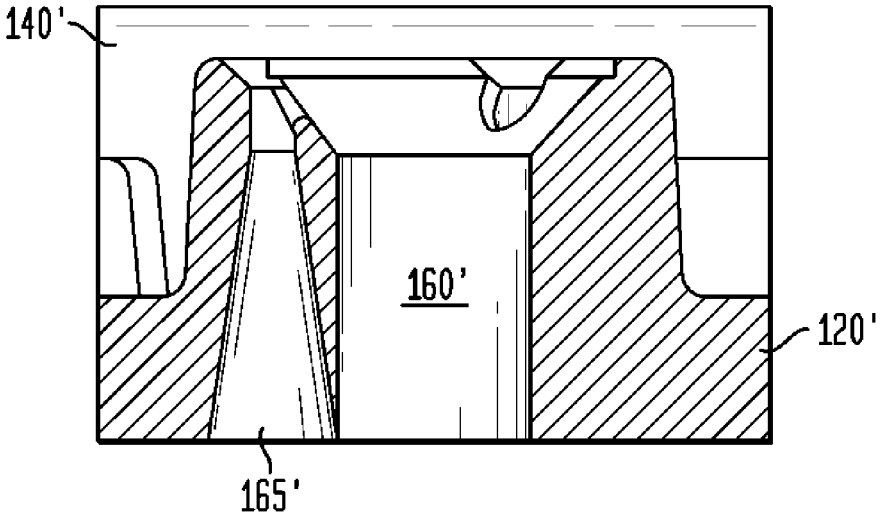
FIG. 12 is a cross section view of the cap clip of FIG. 9 along section B-B.

Each pincer snap 130' includes a single convex plate 140' and concave walls of shared twin clasping section 150' configured to hold a cap of appropriate dimensions. Twin shared clasping section 150' has two generally triangular shaped sections 155', each disposed centrally along the outer perimeter of square base 120'. Fastening devices—not shown—such as screws, nails, tacks, rivets, and the like are inserted into recessed concave openings 160' to attach base 120' to a structure, such as wall, board or other suitable structure. Alternatively, adhesive or adhesive tape may be used on the backside of base 120'. Likewise, the cap clip may be sewed onto a suitable structure using "button" holes 165' located around the perimeter of concave opening 160'. As shown, the diameter of the button holes is not uniform, but rather narrows from the base to the top, as shown in FIG. 12.

Shared clasping section 150' consists of two triangular sections 155' with a spacing centrally disposed therebetween. Each triangular section 155' has two outer concave walls 170' of radius R1' extending vertically upward away from base 120', and joined laterally to each other along a corresponding rounded edge 180'. Each pincer snap 130' consists of a convex plate 140' of radius R2' extending upward away from base 120'. Convex plate 140' lie along a radius of curvature path co-centric with the corresponding concave walls 170' of clasping section 155', and follow nominally the curvature of the cap. Again, the radii of curvature R1' and R2' can be chosen to allow cap clip 100' to meet the specifications of most cap types.

Convex plates 140' are spaced a distance D1' from the corresponding concave walls 170' of shared clasping section 150' by a recessed channel 195' of depth D2'. The distance D1' is judiciously chosen to receive the rim of the bottle cap. Since the convex plates are elastic, caps are held tightly by friction within channel 195'. That is, each convex plate 140' and the corresponding concave wall clasp the outer rim of the cap. Once the cap is removed, the concave plates return to their original position Convex plates 140' do not extend beyond the external dimensions of base 120'. The distal section, however, of the plates preferably have protruding tabs or lips 200' extending generally inward in a radial direction. The tabs are generally perpendicular to the corresponding concave walls 170', and increase the holding friction in the pincer snaps. The back side of base 120' is substantially planar with cut-out rectangular openings 135' centrally located below each tab 200'.

The cap clips of the present invention are preferably unitarily formed of molded plastic, such as Acrylonitrile butadiene styrene (ABS) for manufacturing ease and cost-effectiveness. As shown, the cut-out rectangular openings 135, 135' allow the cap clip to be easily removed from the die mold.

Similarly, cap clip 100' can be interconnected by allowing the cap to snap onto up to four cap clips. In the latter embodiment, and for typical bottle caps having about an outer diameter of about 1.264", thickness of about 0.11", and a height of about 0.2618", the nominal width of cap clip of the present invention would be about 1.0", with a base height of about 0.1". The total height is 0.3". The radii of the convex plates and concave walls are about 0.747" and 0.836", respectively. The spacing D1', and D2' are about 0.045", and 0.02", respectively.

Those skilled in the art will readily note that the present invention provides distinct advantages. Because the cap clip can snap onto more than one cap, each cap need not be individually fastened to a supporting structure. This reduces the number of fasteners required and affording greater ease of assembly.

It should be understood that the embodiments herein are merely illustrative of the principles of the invention. Various modifications may be made by those skilled in the art which will embody the principles of the invention and fall within the scope thereof. Although the invention has been illustrated with the use of two and three pincer snaps, it should be apparent to those skilled in art that the invention has wider applications and can use any number, depending on the size of the cap clip relative to that of the bottle caps. As such, for an appreciation of the true scope and breadth of the invention, reference should be made to the following claims.

The invention claimed is:

1. A cap clip for fastening together caps, comprising:

a base; and three pincer snaps integrally formed with said base and lying near the perimeter of said base and extending vertically from and in a direction generally perpendicular to said base, each of said pincer snaps including first and second convex plates spaced apart to define an inverted T-slot therebetween, and a clasping section centrally disposed and integrally formed on said base, said clasping section including of three outer concave walls extending vertically upward away from and in said direction generally perpendicular to said base and joined laterally to each other along a corresponding edge of the clasping section, wherein each of said first and second convex plates and a corresponding concave wall of said clasping section lie along a concentric path with a recessed channel formed therebetween for securing a cap therein;

wherein a distal end of each of said first and second convex plates defining said inverted T-slot include a tab extending substantially perpendicular toward a corresponding concave wall of said clasping section.

2. The cap clip of claim 1 wherein said base has a triangular shape.

3. The cap clip of claim 1 wherein said pincer snaps are positioned 120 degrees. radially apart from each other.

4. The cap clip of claim 1 wherein said clasping section includes a recessed concave opening.

5. The cap clip of claim 4 wherein said clasping section includes button holes located around a perimeter of said concave opening.

* * * * *